US008298374B2

(12) United States Patent
Shannon et al.

(10) Patent No.: US 8,298,374 B2
(45) Date of Patent: Oct. 30, 2012

(54) TISSUE PRODUCTS CONTAINING MICROALGAE MATERIALS

(75) Inventors: Thomas Gerard Shannon, Neenah, WI (US); Bo Shi, Neenah, WI (US); Ellen Elizabeth Pelky, De Pere, WI (US); Jeffrey Robert Besaw, Appleton, WI (US); David Wesley Bernd, Waupaca, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 15 days.

(21) Appl. No.: 12/972,767

(22) Filed: Dec. 20, 2010

(65) Prior Publication Data

US 2011/0303375 A1 Dec. 15, 2011

Related U.S. Application Data

(60) Provisional application No. 61/353,745, filed on Jun. 11, 2010.

(51) Int. Cl.
*D01C 1/00* (2006.01)

(52) U.S. Cl. ..... 162/99; 162/141; 162/148; 162/158

(58) Field of Classification Search ..... 162/99, 162/141, 148, 158, 164.6, 175
See application file for complete search history.

(56) References Cited

U.S. PATENT DOCUMENTS

| | | | | |
|---|---|---|---|---|
| 1,367,279 | A | 2/1921 | Ignacy | |
| 1,509,035 | A | 9/1924 | Curtis et al. | |
| 1,675,244 | A | 6/1928 | Frederick | |
| 5,472,569 | A * | 12/1995 | Nicolucci et al. | 162/99 |
| 5,500,086 | A * | 3/1996 | Sakai et al. | 162/65 |
| 5,567,275 | A * | 10/1996 | Nicolucci et al. | 162/99 |
| 7,622,019 | B2 * | 11/2009 | You et al. | 162/99 |

FOREIGN PATENT DOCUMENTS

| | | | |
|---|---|---|---|
| EP | 0 565 920 | B1 | 10/1995 |
| EP | 1 682 721 | B1 | 5/2009 |
| GB | 508671 | A | 7/1939 |
| JP | 04-202893 | A | 7/1992 |
| JP | 05-331792 | A | 12/1993 |
| JP | 2000-236757 | A | 9/2000 |
| WO | WO 94/04745 | A1 | 3/1994 |

OTHER PUBLICATIONS

Earthrise® "Natural Spirulina Powder," Material Safety Data Sheet, Earthrise Nutritionals, Calipatria, CA, May 17, 2006, pp. 1-6.

* cited by examiner

*Primary Examiner* — Mark Halpern
(74) *Attorney, Agent, or Firm* — Michael J. Sullivan; R. Joseph Foster, III

(57) ABSTRACT

Dry products, and particularly dry tissue substrates, including a blend of conventional papermaking fibers and microalgae are disclosed herein. Use of a cationic retention aid in the dry tissue substrates helps to provide a tissue sheet retaining the microalgae without being detrimental to tissue properties such as caliper, bulk, air permeability, slough and absorbent capacity. Additionally, use of a flocculating agent may agglomerate the microalgae and make it easier to retain the microalgae within the tissue sheet.

19 Claims, 1 Drawing Sheet

TISSUE PRODUCTS CONTAINING MICROALGAE MATERIALS

This application claims priority from presently U.S. Provisional Application No. 61/353,745 entitled "Tissue Products Containing Microalgae Materials" filed on Jun. 11, 2010, in the names of Thomas Gerard Shannon et al.

BACKGROUND

A major problem affecting pulp and paper industry worldwide is the increasing cost of suitable wood fiber. Consequently, the tissue industry is always searching for alternative low-cost fiber species for sustainable manufacturing. Also environmental groups and consumers who prefer to use green products have advocated for the use of non-wood fibers as being more environmentally friendly than wood fibers. In order to reduce the reliance on commodity wood pulp, the use of recycled fibers can be a partial solution, but the use of recycled fibers in tissue products is technically limited by the end product quality acceptable to users.

As an alternative, certain non-wood fibers, such as field crop fibers or agricultural residues, are considered as being more sustainable. Examples includes kenaf, flax, bamboo, cotton, jute, hemp, sisal, bagasse, corn stover, rice straw, wheat straw, hersperaloe, switchgrass, and the like. Non-wood fibers are believed to account for about 5 to 10 percent of global pulp production, but are limited for a variety of reasons, including seasonal availability, problems with chemical recovery, brightness of the pulp, silica content, etc. In addition, all land based plants still contain substantial quantities of lignin. Significant energy and chemical input is required to remove lignin in order to get fibers suitable for most paper making.

As a further alternative, algae biomass has been proposed as an alternative fiber source and has several advantages. In particular, algae biomass has no lignin and is known to grow faster and provide a higher yield in comparison to fibers harvested from trees. Similarly to trees, algae are efficient in utilizing carbon dioxide in order to abate air pollution and global warming. Algae are also increasingly being used to reduce excessive nutrients in water due to uncontrolled releases of pollutants from industry and human activities. In addition, algae cultivation does not compete for land usage. Over the years, different kinds of algae have been adapted for a variety of industrial applications. For instance, adsorbent materials comprising microalgae, such as *Chlorella* or *Spirulina*, are adapted to remove toxins and odor in cigarette smoke and air, or using brown algae to remove heavy metals from wastewater with absorbent particle sizes varied from 500 μm~2 mm. Others have used the microalgae *Chlorella*, in combination with a consortium of prokaryptic microorganisms, to effectively purify wastewater effluent streams using a photobioreactor. Researchers have developed methods to identify algae species and compositions that are effective for lipid production, wastewater and air remediation, or biomass production.

Recent work in adapting microalgae for industrial uses have concentrated on their refinement as biofuels, which is an outgrowth of increasingly limited fossil fuel resources and relative high cost of petroleum. Biomeal, a leftover waste material from the microalgae to biofuel processing, is normally used for animal feeds. (See, e.g., U.S. Pat. No. 6,338,866 and International Patent Publication No. WO 01/60166 to Criggall et al., which developed methods to manufacture pet or animal foods using such a waste product which includes the cell carcasses that remain after one or more essential fatty acids such as docosahexaenoic acid (DHA) have been extracted from lysed algae cells such as *Crypthecodinium cohnii*; WO Publication No. 2008/039911 to Lo et al. provides a method of optimizing pet food palatable components comprising algal biomeal.)

In many cases, biomeal from microalgae biomass processing is treated as a waste and disposed of in landfills or compost piles. Therefore, a value-added utilization of the microalgae biomass will be a very attractive approach. Activities in microalgae production and utilization will increase in the future because there is a need to reduce global warming and clean up wastewater effluent. On the other hand, petroleum-based oil products that predominate in the energy market today are not sustainable. As a result, it is expected that there is a large amount of microalgae to be used for biofuel refining processes described in U.S. Patent Application Publication Nos. 2008/0155888 to Vick et al. and 2008/0090284 to Hazlebeck et al. Biomeal or a leftover material from microalgae to biofuel refining processes will be abundantly available because the estimated microalgal meal as a byproduct is 0.77 pound for every pound of microalgae processed for oil. Therefore, effective utilization of such a waste material for use in tissue products manufacturing becomes important to any business that is currently depending on petroleum as a feedstock.

Microalgae are generally very small. The small size causes difficulties and limits in the amount of microalgae that can be maintained within the fiber sheet, particularly in low basis weight paper products such as tissue. Small size and lack of significant amounts of cellulosic material may also result in lower strength. Accordingly, there exists a need for methods for increasing the microalgae retention of fiber sheets. Therefore, there is a need to provide a way to effectively utilize algae biomass in the manufacture of tissue products, such as facial tissue, bath tissue and paper towels.

SUMMARY

Generally, dry paper products, and particularly dry tissue substrates, including a blend of conventional papermaking fibers and microalgae are disclosed herein. Use of an ionic retention aid, preferably a cationic retention aid, in the process of making tissue substrates helps to provide a tissue sheet retaining the microalgae without being detrimental to tissue properties such as caliper, bulk, air permeability, slough and absorbent capacity. Additionally, use of a flocculating agent may agglomerate the microalgae and make it easier to retain the microalgae within the tissue sheet.

Desirably, the amount of microalgae present in the tissue product can be from about 1 to about 50 weight percent, more desirably about 10 to about 40 weight percent, and even more desirably, about 10 to 30 weight percent based on total weight of fiber in the tissue product.

Tissue products can be differentiated from other paper products in terms of their bulk. The bulk of the tissue products of the present disclosure may be calculated as the quotient of the caliper expressed in microns, divided by the basis weight, expressed in grams per square meter. The resulting bulk is expressed as cubic centimeters per gram. Writing papers, newsprint and other such papers have higher strength, stiffness and density (low bulk) in comparison to tissue products of the present disclosure which tend to have much higher calipers for a given basis weight. The bulk of the tissue web can range between about 2 to about 25 $cm^3/g$, more specifically between about 3 to about 20 $cm^3/g$, and still more specifically between about 4 to about 18 $cm^3/g$.

The caliper of the tissue web, while not important to the invention, may be at least about 90 micron or greater, and is desirably from about 90 to about 1200 micron, and particularly about 100 to about 900 micron.

The tissue product described herein may have a specific absorbent capacity expressed as grams of water absorbed per gram of fiber of about 6 g/g or greater, between about 7 to about 18 g/g, or between about 8 to about 18 g/g.

The tissue product described herein may have a geometric mean tensile strength expressed in grams (force) per 3 inches of sample width of about 200 g/3" or greater, or between about 300 to about 4500 g/3". Where multi-ply products are used the tensile strength per ply shall be taken as equivalent to the tensile strength of the multi-ply product divided by the number of plies.

BRIEF DESCRIPTION

The above aspects and other features, aspects, and advantages of the present invention will become better understood with regard to the following description, appended claims, and accompanying drawings in which:

Figure 1:
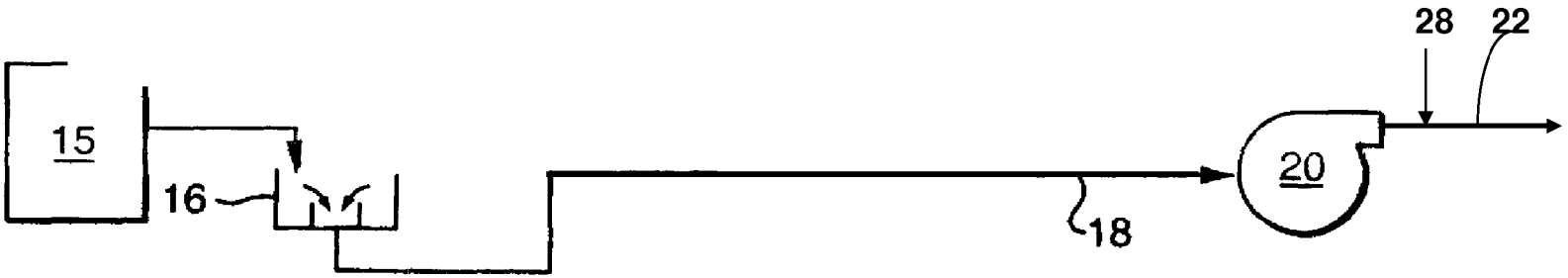
FIG. 1 is a schematic flow diagram of a wet-end stock system useful for purposes of this invention.

Repeated use of reference characters in the specification and drawings is intended to represent the same or analogous features or elements of the invention in different embodiments.

DETAILED DESCRIPTION

It is to be understood by one of ordinary skill in the art that the present discussion is a description of exemplary embodiments only, and is not intended as limiting the broader aspects of the present invention, which broader aspects are embodied in the exemplary construction.

Tissue basesheet, as used herein, refers to the single ply tissue produced on the tissue machine prior to converting to a final product. Tissue product, as used herein, refers to the finished tissue product wherein the tissue basesheet has been converted into a final product such as, but not limited to, a bath tissue, a facial tissue, a napkin, a paper towel or a general purpose wiping product. Tissue products of the present invention may comprise one or more plies of the tissue basesheet. Tissue products of the present invention may therefore be single ply or multiple ply. Tissue products may have the same mechanical properties as the tissue basesheets, differing only in physical dimension or format such as folded or rolled. However, as those skilled in the art will recognize, the tissue products may have different mechanical as well as physical properties depending upon the nature of the actions taken to convert the tissue basesheet to tissue product.

Generally, dry products, and particularly dry tissue substrates, including a blend of conventional papermaking fibers and microalgae fibrous materials are disclosed herein. While microalgae may be incorporated into tissue products in order to render the products more environmentally friendly, several drawbacks exist as a result of the incorporation of the microalgae into tissue products. One such drawback of using microalgae involves the weak retention of microalgae within conventional papermaking fibers due to their small size. Surprisingly and unexpectedly, use of a cationic retention aid will help reduce this retention problem and provides a tissue sheet containing microalgae without being detrimental to tissue properties such as caliper, bulk, air permeability, slough and absorbent capacity. Additionally, use of a flocculating agent may agglomerate the microalgae and make it easier to retain the microalgae within the tissue sheet. Bulk and absorbent capacity have actually been found to increase when microalgae is incorporated into tissue, in particular through air dried tissue which is routinely used in bath tissue and paper towels.

Microalgae comprise a vast group of photosynthetic, heterotrophic organisms which have an extraordinary potential for cultivation as energy crops. They can be cultivated under difficult agro-climatic conditions and are able to produce a wide range of commercially interesting byproducts such as fats, oils, sugars and functional bioactive compounds. As a group, they are of particular interest in the development of future renewable energy scenarios. Certain microalgae are effective in the production of hydrogen and oxygen through the process of biophotolysis while others naturally manufacture hydrocarbons which are suitable for direct use as high-energy liquid fuels. It is this latter class that is the subject of this brief.

Once grown, the harvesting and transportation costs of algae species are lower than that of conventional crops and their small size allows for a range of cost-effective processing options. They are easily studied under laboratory conditions and can effectively incorporate stable isotopes into their biomass, thus allowing effective genetic and metabolic research to be carried out in a much shorter time period than conventional plants.

The microalgae for use in the methods and the tissue product described herein can be marine or freshwater microalgae. The microalgae can be selected from, but not limited to, non-motile unicellular algae, flagellates, diatoms and blue-green algae. The microalgae can be selected from, but not limited to, the families of *Dunaliella, Chlorella, Tetraselmis, Botryococcus, Haematococcus, Phaeodactylum, Skeletonema, Chaetoceros, Isochrysis, Nannochloropsis, Nannochloris, Pavlova, Nitzschia, Pleurochrysis, Chlamydomas* or *Synechocystis*. The microalgae will desirably have a size in the longest dimension of less than about 500 μm and preferably less than 300 μm, and even more preferably less than 200 μm.

Desirably, the amount of microalgae present in the tissue product can be from about 1 to about 50 weight percent, more desirably about 10 to about 40 weight percent, and even more desirably, about 10 to 30 weight percent based on total weight of fiber in the tissue product.

Unexpectedly, including microalgae in the tissue substrate results in an increase in bulk and water retention. This is a clear benefit to tissue but a detriment to fine paper that might use the microalgae within the pulp sheet.

In one particular embodiment, *Spirulina* is used for the microalgae in the tissue basesheet. *Spirulina* is high in protein and relatively low in carbohydrate. Generally, *Spirulina* is 60 to 70 percent protein, 15 to 25 percent carbohydrate, 4 to 7 percent fat and 4 to 7 percent fiber. One skilled in the art might consider algal biomeal not useful in paper due to low amount of carbohydrates, and in particular cellulose, within the biomeal. However, high protein content microalgae such as *Spirulina* may be used without the loss of strength in the basesheet. Thus, the microalgae for use with the tissue basesheet may have a protein content of greater than 50 percent.

Conventional papermaking fibers suitable for making tissue products contain any natural or synthetic cellulosic fibers including, but not limited to, nonwoody fibers, such as cotton, abaca, kenaf, sabai grass, flax, esparto grass, straw, jute hemp, bagasse, milkweed floss fibers, and pineapple leaf fibers; and woody or pulp fibers such as those obtained from deciduous and coniferous trees, including softwood fibers, such as northern and southern softwood kraft fibers; and hardwood fibers, such as eucalyptus, maple, birch, and aspen. Pulp fibers can be prepared in high-yield or low-yield forms and can be pulped in any known method, including kraft, sulfite, high-yield pulping methods and other known pulping methods. Fibers prepared from organosolv pulping methods can also be used, including the fibers and methods disclosed in U.S. Pat. No. 4,793,898 issued Dec. 27, 1988 to Laamanen et al.; U.S. Pat. No. 4,594,130 issued Jun. 10, 1986 to Chang et al.; and U.S. Pat. No. 3,585,104 issued Jun. 15, 1971 to Kleinert. Useful fibers can also be produced by anthraquinone pulping, exemplified by U.S. Pat. No. 5,595,628 issued Jan. 21, 1997 to Gordon et al.

A portion of the fibers, such as up to 50 percent or less by dry weight, or from about 5 to about 30 percent by dry weight, can be synthetic fibers such as rayon, polyolefin fibers, polyester fibers, bicomponent sheath-core fibers, multi-component binder fibers, and the like. An exemplary polyethylene fiber is Pulpex®, available from Hercules, Inc. (Wilmington, Del.). Any known bleaching method can be used. Synthetic cellulose fiber types include rayon in all its varieties and other fibers derived from viscose or chemically-modified cellulose. Chemically treated natural cellulosic fibers can be used such as mercerized pulps, chemically stiffened or crosslinked fibers, or sulfonated fibers. For good mechanical properties in using papermaking fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. Suitable papermaking fibers can also include recycled fibers, virgin fibers, or mixes thereof. In certain embodiments capable of high bulk and good compressive properties, the fibers can have a Canadian Standard Freeness of at least 200, more specifically at least 300, more specifically still at least 400, and most specifically at least 500.

Other papermaking fibers may include paper broke or recycled fibers and high yield fibers. High yield pulp fibers are those papermaking fibers produced by pulping processes providing a yield of about 65 percent or greater, more specifically about 75 percent or greater, and still more specifically about 75 to about 95 percent. Yield is the resulting amount of processed fibers expressed as a percentage of the initial wood mass. Such pulping processes include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high yield sulfite pulps, and high yield Kraft pulps, all of which leave the resulting fibers with high levels of lignin. High yield fibers are well known for their stiffness in both dry and wet states relative to typical chemically pulped fibers.

In addition, the tissue product may optionally include flocculating agents. Use of a flocculating agent may agglomerate the microalgae and make it easier to retain the microalgae within the tissue sheet.

Exemplary flocculating agents may be selected from starches and modified starches (e.g. cationic or amphoteric starch), cellulose ethers (e.g. carboxymethyl cellulose (CMC)) and derivatives thereof; alginates; cellulose esters; ketene dimers; succinic acid or anhydride polymers; natural gums and resins (especially mannogalactans, e.g. guar gum or locust bean gum) and the corresponding modified (e.g. cationic or amphoteric) natural gums and resins (e.g. modified guar gum); proteins (e.g. cationic proteins), for example soybean protein; poly(vinyl alcohol); and poly(vinyl acetate), especially partially hydrolyzed poly(vinyl acetate). The flocculating agents will, for the most part, also act to agglomerate the microalgae together. Cationic and amphoteric starches have been found to be particularly effective as a flocculating agent. Other particularly effective flocculating agents are polyvinyl amines and derivatives of polyvinyl amines such as Catiofast® and Luredur® resins manufactured and marketed by BASF such as, but not limited to, Luredur PR8095 and Catiofast VFH, Catiofast PR8236, Catiofast PR8104, Catiofast PR8102, Catiofast PR8087 and Catiofast PR8085.

As mentioned above, flocculating agents are used to agglomerate the microalgae and make it easier to retain them within the tissue sheet. While not wishing to be bound by any theory, it is believed that the flocculating agent becomes insoluble after binding to the charged microalgae. The goal of agglomeration is to have the microalgae covered with the bushy flocculating agent molecules. The starch molecules provide a cationic surface for the attachment of more microalgae, causing an increase in agglomerate size and increasing the ability of the algae to be retained in the web.

The size of the starch-microalgae agglomerates is an important factor in obtaining the optimal balance of strength and optical properties. Agglomerate size is controlled by the rate of shear supplied during the mixing of the starch with the pulp suspension. The agglomerates, once formed, are not overly shear sensitive, but they can be broken down over an extended period of time or in the presence of very high shear forces. In particular, such high shear forces may be found in the fan pump that feeds the dilute pulp suspension to the headbox of the tissue machine.

The charge characteristic of the flocculating agent is significant as well. For example, starch is usually employed at an amount of less than 5 percent by weight of microalgae; the microalgae-starch agglomerates still possess a net negative charge. In this case, a cationic retention aid is utilized. At other times, at may be beneficial to employ an anionic or an amphoteric retention aid.

Various cationic retention aids are known in the art. Generally, the most common cationic retention aids are charged polyacrylamides. These retention aids agglomerate the suspended particles through the use of a bridging mechanism. A wide range of molecular weights and charge densities are available. In general, high molecular weight materials with a medium charge density are preferred for flocculating the microalgae. The retention aid flocs are easily broken down by shear forces and are therefore usually added after the fan pump that supplies the dilute pulp suspension to the headbox of the tissue machine.

Examples of cationic polymeric retention aids are polydiallyldimethyl-ammonium chlorides (polyDADMAC) and branched polyacrylamides, which can be prepared, for example, by copolymerization of acrylamide or methacrylamide with at least one cationic monomer in the presence of small amounts of crosslinking agents.

Suitable cationic retention aids are polyamines having a molar mass of more than 50 000, modified polyamines which are grafted with ethylenimine and, if appropriate, crosslinked polyetheramides, polyvinylimidazoles, polyvinylpyrrolidines, polyvinylimidazolines, polyvinyltetrahydropyrines, poly(dialkylaminoalkyl vinylethers), poly(dialkylaminoalkyl(meth)acrylates) in protonated or in quaternized form and polyamidoamines obtained from a dicarboxylic acid, such as adipic acid, and polyalkylenepolyamines, such as diethylenetriamine, which are grafted with ethylenimine and crosslinked with polyethylene glycol dichlorohydrin ether or polyamidoamines which are reacted with epichlorohydrin to give water-soluble condensates. Further retention aids are cationic starches, alum and polyaluminum chloride.

Tissue basesheets that may be used to construct the tissue product, for instance, can generally contain pulp fibers either alone or in combination with other fibers. Each tissue web can generally have a bulk density of at least 2 $cm^3/g$, such as at least 3 $cm^3/g$, and more typically of at least 4 $cm^3/g$.

The tissue products of the present invention may be single ply or multiple ply products. The tissue basesheets may include a single homogenous layer of fibers, called a blended basesheet, or may include a stratified or layered construction wherein the tissue basesheet ply may include two or three or more layers or plies of fibers. Each layer may have a different fiber composition. The microalgae may be selectively located in one or several layers or may be located in all layers of the layered basesheet.

The basis weight of the basesheet used for the individual plies comprising the tissue product can vary depending upon the final product. For example, the process may be used to produce facial tissues, bath tissues, paper towels, industrial wipers, and the like. In general, the basis weight of the basesheet or individual ply of the tissue products may vary from about 5 to about 120 gsm, such as from about 7 to about 80 gsm. For bath and facial tissues, for instance, the basis weight of the individual plies comprising the tissue product may range from about 7 to about 60 gsm. For paper towels, on the other hand, the basis weight may range from about 10 to about 80 gsm.

In multiple ply products, the basis weight of each tissue web present in the product can also vary. In general, the total basis weight of a multiple ply product will generally be the same as indicated above multiplied by the number of plies, In particular multi-ply products of the present invention may have basis weights, such as from about 15 to about 100 gsm. Thus, the basis weight of each ply can be from about 5 to about 100 gsm, such as from about 7 to about 50 gsm.

In general, The tissue sheet may be formed using any suitable papermaking techniques, For example, a papermaking process can utilize creping, wet creping, double creping, embossing, wet pressing, air pressing, through-air drying, creped through-air drying, uncreped through-air drying, hydroentangling, air laying, as well as other steps known in the art.

One such exemplary technique will be hereinafter described. A wet-end stock system which could be used in the manufacture of a tissue product is illustrated in FIG. 1. The wet-end stock system includes a chest 15 for storage of an aqueous suspension blend of papermaking fibers and microalgae. A cationic flocculating agent may generally be employed in order to flocculate the microalgae at an amount. When employed, the cationic starch may be added up to about 5 percent by weight of the microalgae, and more desirably about 3 percent by weight of the microalgae. From chest 15, the fiber-water suspension enters the stuff box 16 used to maintain a constant pressure head. Often, the entire outlet of the stuff box 16 is sent via outlet stream 18 to a fan pump 20. Alternatively, however, a portion of the outlet stream 17 of the stuffbox 16 can be drawn off as a separate stream and sent to the fan pump 20 while the remaining portion can be recirculated back to the stuffbox 16, as disclosed in U.S. Pat. No. 6,027,611 to McFarland et al., which is hereby incorporated by reference herein.

Figure 2:
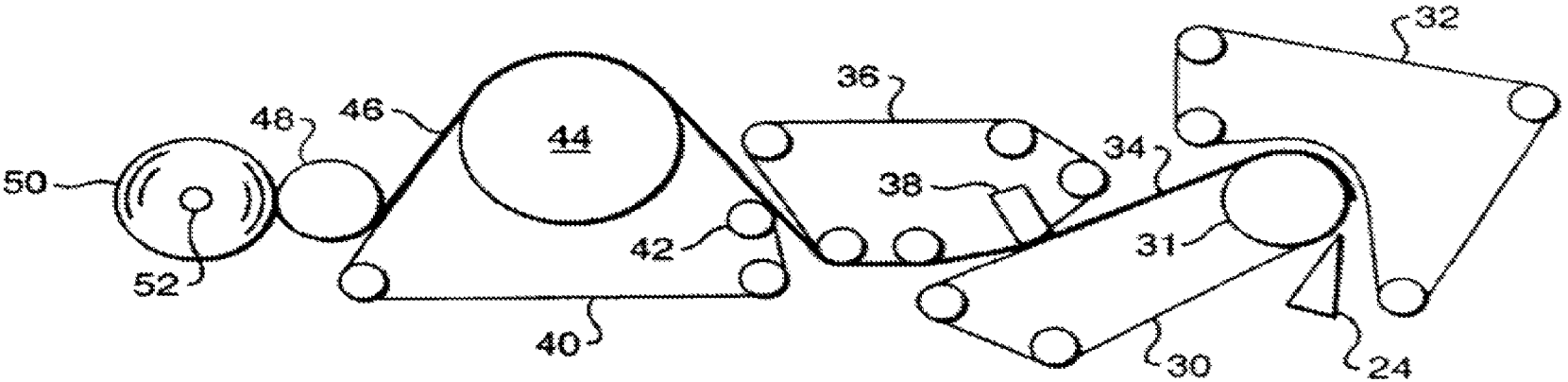
FIG. 2 is a schematic flow diagram of an uncreped through-dried tissue making process in accordance with this invention.

The retention aid may be added at any point between the chest 15 and the headbox 24 (FIG. 2), such as, for example, additive point 26, shown in FIG. 2. Desirably, the retention aid is added at an outlet side of the chest fan pump 20. The cationic retention aid is added to improve retention of the microalgae. When employed, the retention aid is usually added after the fan pump at a level of 0.1 to 1.5 pounds per metric ton dry fiber.

A schematic process flow diagram of the machine used to manufacture a sized tissue product is illustrated in FIG. 2. The machine includes headbox 24 which receives the discharge or outlet stream 22 from the fan pump 20 and continuously injects or deposits the aqueous paper fiber suspension onto an inner forming fabric 30 as it traverses a forming roll 31. An outer forming fabric 32 serves to contain the web while it passes over the forming roll 31 and sheds some of the water. The wet web 34 is then transferred from the inner forming fabric 30 to a wet end transfer fabric 36 with the aid of a vacuum transfer shoe 38. This transfer is preferably carried out with the transfer fabric 36 travelling at a slower speed than the inner forming fabric 30 (rush transfer) to impart stretch into the final tissue product. The wet web 34 is then transferred to the throughdrying fabric 40 with the assistance of a vacuum transfer roll 42. The throughdrying fabric 40 carries the wet web 34 over the throughdryer 44, blowing hot air through the web 34 to dry it while preserving bulk. There optionally can be more than one throughdryer in series (not shown), depending on the speed and the dryer capacity. The dried tissue sheet 46 is then transferred to a reel drum 48 directly from the throughdrying fabric 40. The transfer is accomplished using vacuum suction from within the reel drum 48 and/or pressurized air. The tissue sheet 46 is then wound into a roll 50 on a reel 52. U.S. Pat. No. 5,591,309 to Rugowski et al., which is hereby incorporated by reference herein, discloses the same and additional techniques for throughdrying a wet-laid sheet, as does U.S. Pat. Nos. 5,399,412 to Sudall et al. and 5,048,589 to Cook et al., both of which are also hereby incorporated by reference herein.

The tissue product can be a high bulk material. The bulk of the tissue product can range between about 2 to about 25 $cm^3/g$, more specifically between about 3 to about 20 $cm^3/g$, and still more specifically between about 4 to about 18 $cm^3/g$.

The caliper of the single-ply tissue may be at least about 60 micron or greater, and is desirably from about 90 to about 1200 micron, and particularly about 120 to about 1000 micron. Similarly the caliper of the tissue products of the present invention may range from about 90 to about 1500 micron such as from about 120 to about 1200 micron.

The tissue product and tissue basesheet described herein may have a specific absorbent capacity expressed as grams of water absorbed per gram of fiber of about 6 g/g or greater, between about 7 to about 18 g/g, or between about 8 to about 16 g/g.

The tissue product described herein may have a geometric mean tensile strength expressed as expressed in grams (force) per 3 inches of sample width of about 400 g/3" or greater, or between about 600 to about 4500 g/3".

Test Methods

Basis Weight

The basis weight and bone dry basis weight of the tissue sheet specimens are determined using TAPPI T410 procedure or a modified equivalent such as: Tissue samples are conditioned at 23° C.±1° C. and 50±2 percent relative humidity for a minimum of 4 hours. After conditioning a stack of 16-3-inch by 3-inch samples is cut using a die press and associated die. This represents a tissue sheet sample area of 144 $in^2$ or 929 $cm^2$. Examples of suitable die presses are TMI DGD die press manufactured by Testing Machines, Inc., Islandia, N.Y., or a Swing Beam testing machine manufactured by USM Corporation, Wilmington, Mass. Die size tolerances are ±0.008 inches in both directions. The specimen stack is then weighed to the nearest 0.001 gram on a tared analytical balance. The basis weight in grams per square meter is calculated using the following equation: Basis weight=stack wt. in grams/0.0929.

Geometric Mean Tensile Strength

For purposes herein, tensile strength may be measured using an Sintech tensile tester using a 3-inch jaw width (sample width), a jaw span of 2 inches (gauge length), and a crosshead speed of 25.4 centimeters per minute after maintaining the sample under TAPPI conditions for 4 hours before testing. The "MD tensile strength" is the peak load per 3 inches of sample width when a sample is pulled to rupture in the machine direction. Similarly, the "CD tensile strength" represents the peak load per 3 inches of sample width when a sample is pulled to rupture in the cross-machine direction. The geometric mean tensile strength (GMT) is the square root of the product of the machine direction tensile strength and the cross-machine direction tensile strength of the web. The "CD stretch" and the "MD stretch" are the amount of sample elongation in the cross-machine direction and the machine direction, respectively, at the point of rupture, expressed as a percent of the initial sample length.

More particularly, samples for tensile strength testing are prepared by cutting a 3 inch (76.2 mm) wide by at least 4 inches (101.6 mm) long strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333). The instrument used for measuring tensile strength is an MTS Systems Sintech Serial No. 1G/071896/116. The data acquisition software is MTS TestWorks® for Windows Ver. 4.0 (MTS Systems Corp., Eden Prairie, Minn.). The load cell is an MTS 25 Newton maximum load cell. The gauge length between jaws is 2±0.04 inches (76.2±1 mm). The jaws are operated using pneumatic action and are rubber coated. The minimum grip face width is 3 inches (76.2 mm), and the approximate height of a jaw is 0.5 inches (12.7 mm). The break sensitivity is set at 40 percent. The sample is placed in the jaws of the instrument, centered both vertically and horizontally. To adjust the initial slack, a pre-load of 1 gram (force) at the rate of 0.1 inch per minute is applied for each test run. The test is then started and ends when the force drops by 40 percent of peak. The peak load is recorded as either the "MD tensile strength" or the "CD tensile strength" of the specimen depending on the sample being tested. At least 3 representative specimens are tested for each product, taken "as is", and the arithmetic average of all individual specimen tests is either the MD or CD tensile strength for the product.

As used herein, the "geometric mean tensile strength" is the square root of the product of the MD tensile strength multiplied by the CD tensile strength, both as determined above, expressed in grams (force) per 3 inches of sample width.

Caliper and Bulk

The bulk of the basesheet and individual sheets making up the multi-ply product may or may not be the same. However, the tissue products of the present invention will have a bulk greater than about 2 cubic centimeters per gram or greater and more specifically from about 3 to about 24 cubic centimeters per gram, more specifically from about 4 to about 16 cubic centimeters per gram.

Single sheet bulk is calculated by taking the single sheet caliper and dividing by the conditioned basis weight of the product. The term "caliper" as used herein is the thickness of a single tissue sheet, and may either be measured as the thickness of a single tissue sheet or as the thickness of a stack of ten tissue sheets and dividing the ten tissue sheet thickness by ten, where each sheet within the stack is placed with the same side up.

As used herein, the sheet "caliper" is the representative thickness of a single sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

As used herein, the sheet "bulk" is calculated as the quotient of the "caliper", expressed in microns, divided by the dry basis weight, expressed in grams per square meter. The resulting sheet bulk is expressed in cubic centimeters per gram.

Slough

In order to determine the abrasion resistance or tendency of the fibers to be rubbed from the web when handled, each sample was measured by abrading the tissue specimens via the method as is described further in U.S. Pat. No. 6,861,380 to Garnier et al., hereby incorporated by reference. This test measures the resistance of tissue material to abrasive action when the material is subjected to a horizontally reciprocating surface abrader. All samples were conditioned at 23° C.±0.1° C. and 50 percent±0.2 percent relative humidity for a minimum of 4 hours.

The abrading spindle contained a stainless steel rod, 0.5 inches in diameter with the abrasive portion consisting of a 0.005 inch deep diamond pattern extending 4.25 inches in length around the entire circumference of the rod. The spindle was mounted perpendicularly to the face of the instrument such that the abrasive portion of the rod extends out its entire distance from the face of the instrument. On each side of the spindle were located guide pins with magnetic clamps, one movable and one fixed, spaced 4 inches apart and centered about the spindle. The movable clamp and guide pins were allowed to slide freely in the vertical direction, the weight of the jaw providing the means for insuring a constant tension of the sample over the spindle surface.

Using a die press with a die cutter, the specimens were cut into 3 inch±0.05 inch wide by 8 inch long strips with two holes at each end of the sample. For the tissue samples, the MD direction corresponds to the longer dimension. Each test strip was then weighed to the nearest 0.1 mg. Each end of the sample was slid onto the guide pins and magnetic clamps held the sheet in place. The movable jaw was then allowed to fall providing constant tension across the spindle.

The spindle was then moved back and forth at an approximate 15 degree angle from the centered vertical centerline in a reciprocal horizontal motion against the test strip for 20 cycles (each cycle is a back and forth stroke), at a speed of 80 cycles per minute, removing loose fibers from the web surface. Additionally, the spindle rotated counter clockwise (when looking at the front of the instrument) at an approximate speed of 5 RPMs. The magnetic clamp was then removed from the sample and the sample was slid off of the guide pins and any loose fibers on the sample surface were removed by blowing compressed air (approximately 5 to 10 psi) on the test sample. The test sample was then weighed to the nearest 0.1 mg and the weight loss calculated. Ten test samples per tissue sample were tested and the average weight loss value in milligrams was recorded.

Absorption Capacity

A 4 inch by 4 inch specimen is initially weighed. The weighed specimen is then soaked in a pan of test fluid (e.g. paraffin oil or water) for three minutes. The test fluid should be at least 2 inches (5.08 cm) deep in the pan. The specimen is removed from the test fluid and allowed to drain while hanging in a "diamond" shaped position (i.e. with one corner at the lowest point). The specimen is allowed to drain for three minutes for water and for five minutes for oil. After the allotted drain time the specimen is placed in a weighing dish and then weighed. Absorbency of acids or bases, having a viscosity more similar to water, is tested in accord with the procedure for testing absorption capacity for water. Absorption Capacity (g)=wet weight (g)−dry weight (g); and Specific Absorption Capacity (g/g)=Absorption Capacity (g)/dry weight (g).

EXAMPLE

The present disclosure may be better understood with reference to the following example. For Examples 1-3, a blend of conventional papermaking fibers and microalgae was prepared. *Eucalyptus* hardwood fibers commercially available from Fibria, Sao Paulo, Brazil were used. *Spirulina* algae was obtained as "Natural *Spirulina* Powder" commercially available from Earthwise Nutritionals, Calipatria, Calif. In Examples 1 to 3, a single ply, three-layered, uncreped throughdried tissue basesheet was made generally in accordance with U.S. Pat. No. 5,607,551 to Farrington et al. which is hereby incorporated by reference herein.

More specifically, 65 pounds (oven dry basis) of eucalyptus hardwood Kraft fiber was dispersed in a pulper for 25 minutes at a consistency of 3 percent before being transferred in equal parts to two machine chests and diluted to a consistency of 1 percent. Where used, algae was added as a dry powder in equal amounts to each machine chest. Algae was added over a period of 5 minutes so as to avoid clumping and then allowed to disperse for 5 minutes more in the machine chest prior to addition of starch, if used. An amphoteric starch, Redibond 2038A, available as a 30 percent actives aqueous solution from National Starch and Chemical was used. The appropriate amount of starch to add was determined from the amount of *Eucalyptus* in each machine chest. The appropriate amount of starch was weighed out and diluted to a 1 percent actives solution with water prior to being added to the machine chest. When algae was used, the starch was added after the addition of the algae. The fiber slurry was allowed to mix for 5 minutes prior to the stock solution being sent to the headbox.

40 pounds (oven dry basis) of northern softwood kraft fiber were dispersed in a pulper for 25 minutes at a consistency of 3 percent before being transferred to a second machine chest and diluted to 1 percent consistency. The softwood fibers may be refined after pulping and prior to transfer to the machine chest as noted in examples.

Prior to forming, each stock was further diluted to approximately 0.1 percent consistency and transferred to a 3-layer headbox in such a manner as to provide a layered sheet comprising 65 percent *Eucalyptus* and 35 percent NSWK wherein the outer layers comprised the *Eucalyptus*/algae blend and the inner layer comprised the NSWK fibers. A solution of a medium molecular weight cationic retention aid, Praestol 120L, available from Ashland Chemical was prepared by adding 80 grams of Praestol 120L as received to 80 liters of water under high shear agitation. The dilute solution was added in-line at the outlet side of the fan pump of each *Eucalyptus* pulp stream as the dilute pulp suspension traveled to the head box at a rate of from about 0.035 to 0.040 percent by weight of fiber.

The formed web was non-compressively dewatered and rush-transferred to a transfer fabric traveling at a speed about 25 percent slower than the forming fabric. The web was then transferred to a throughdrying fabric, dried and calendered. Basis weights of the inner and outer layers were determined individually to insure that a 32.5/35/32.5 layer split was maintained.

Several Comparative examples were prepared to illustrate the effect of adding microalgae, a retention aid, and starch as described above. Comparative Example 1 was made with only *Eucalyptus* and NSWK fibers. Comparative Example 2 was made with only *Eucalyptus* fibers and microalgae. Comparative Example 3 was made with only *Eucalyptus* fibers, microalgae and starch. Comparative Example 4 was made with only *Eucalyptus* fibers and starch. Comparative Example 5 was made with only *Eucalyptus* starch and a retention aid. The color of the basesheet was noted. The higher degree of green color noted indicates that more algae was retained in the sheet. Thus, Examples 1, 2, and 3 containing microalgae, a flocculating agent, and a retention aid retained the most amount of microalgae within the tissue sheet. Also, surprisingly, despite the introduction of very small particles of algae, reductions in slough are achieved.

TABLE 1

| Example | Microalgae - Weight percent of total sheet | Starch - Weight percent of total sheet | Retention Aid Weight percent of total sheet | Color |
|---|---|---|---|---|
| 1 | 6 | 0.18 | 0.035 | Dark green |
| 2 | 12 | 0.36 | 0.035 | Dark green |
| 3 | 18 | 0.54 | 0.040 | Very dark green |
| Comparative 1 | 0 | 0 | 0 | White |
| Comparative 2 | 6 | 0 | 0 | Very faint green |
| Comparative 3 | 6 | 0.18 | 0 | Very faint green |
| Comparative 4 | 0 | 0.54 | 0 | White |
| Comparative 5 | 0 | 0.54 | 0.040 | White |

Table 2 provides a summary of specific test results on basesheet. Results in Table 2 show that the inclusion of microalgae, a retention aid and a flocculating agent has a significant impact on increasing bulk and specific water absorption capacity while also maintaining low slough and high air permeability. As illustrated by comparative example 5, the increase in bulk and water absorption capacity is above and beyond what is experienced from addition of the starch and retention aid only.

TABLE 2

| Code | GMT (g/3") | Basis Weight ($g/m^2$) | Caliper (micron) | Slough (mg) | Bulk ($cm^3/g$) | Specific Abs. Capacity (g/g) |
|---|---|---|---|---|---|---|
| 1 | 1158 | 31.3 | 590 | 1.68 | 19.1 | 13.16 |
| 2 | 1169 | 30.8 | 590 | 1.68 | 19.2 | 13.39 |
| 3 | 1171 | 28.1 | 590 | 1.50 | 21.0 | 13.91 |
| Comparative 1 | 1158 | 32.6 | 548 | 4.36 | 16.8 | 11.91 |
| Comparative 2 | 1031 | 32.6 | 568 | 3.26 | 17.4 | 12.13 |
| Comparative 3 | 1083 | 31.0 | 557 | 2.88 | 18.0 | 12.26 |
| Comparative 4 | 1200 | 31.8 | 561 | 1.62 | 17.6 | 12.14 |
| Comparative 5 | 1332 | 30.7 | 575 | 1.38 | 18.7 | 12.97 |

Having described the disclosure in detail, it will be apparent that modifications and variations are possible without departing from the scope of the disclosure defined in the appended claims.

We claim:

1. A tissue basesheet comprising:

a blend of conventional papermaking fibers and microalgae; and a cationic retention aid selected from polydiallyldimethylammonium chlorides and branched polyacrylamides;

a flocculating agent selected from the group consisting of a cationic starch, an amphoteric starch and a polyvinylamine or derivative thereof;

said tissue basesheet comprising between about 1 and about 50 percent based on total weight of the tissue product of the microalgae and wherein the tissue basesheet has a basis weight less than about 60 grams per square meter and a bulk greater than about 10 cc/g.

2. The tissue basesheet of claim 1 wherein the microalgae is biomeal from algal biofuel production.

3. The tissue basesheet of claim 1 comprising less than about 5 percent of flocculating agent based on weight of the microalgae.

4. The tissue basesheet of claim 1 wherein the microalgae are selected from non-motile unicellular algae, flagellates, diatoms and blue-green algae.

5. The tissue basesheet of claim 1 comprising between about 10 and about 40 percent based on total weight of the tissue product of the microalgae.

6. The tissue basesheet of claim 1 comprising between about 10 and about 30 percent based on total weight of the tissue product of the microalgae.

7. The tissue basesheet of claim 1 wherein the tissue product has a specific absorbent capacity of about 8 g/g or greater.

8. The tissue basesheet of claim 1 wherein the tissue product has a geometric mean dry tensile strength greater than about 500 g/3".

9. A tissue product comprising one or more plies of the tissue basesheet of claim 1.

10. The tissue product of claim 9 wherein the tissue product is a bath tissue, a facial tissue, a paper towel or a napkin.

11. A method of making a tissue basesheet in a wet-end stock system including a chest and a head box comprising:

a. combining microalgae fibrous material with conventional papermaking fibers in a wet state to produce a microalgae/papermaking fiber blend;

b. adding a cationic retention aid selected from polydiallyldimethylammonium chlorides and branched polyacrylamides and a flocculating agent selected from the group consisting of a cationic starch, an amphoteric starch and a polyvinylamine or derivative thereof to the microalgae/papermaking fiber blend between the chest and the headbox;

c. drying the web to form a tissue basesheet wherein the tissue basesheet has a basis weight less than about 60 grams per square meter and a bulk greater than about 10 cc/g.

12. The method of claim 11 wherein the microalgae is biomeal from algal biofuel production.

13. The method of claim 11 wherein the cationic retention aid is added at an outlet stream of a chest fan pump.

14. The method of claim 12 wherein the tissue product comprises less than about 5 percent of flocculating agent based on weight of the microalgae.

15. The method of claim 11 wherein the microalgae are selected from non-motile unicellular algae, flagellates, diatoms and blue-green algae.

16. The method of claim 11 wherein the tissue basesheet comprises between about 10 and about 50 percent based on total weight of the tissue product of the microalgae.

17. The method of claim 11 wherein the tissue basesheet comprises between about 10 and about 40 percent based on total weight of the tissue product of the microalgae.

18. The method of claim 11 wherein the tissue basesheet has a specific absorbent capacity of about 8 g/g or greater.

19. The method of claim 11 wherein the tissue basesheet comprises a geometric mean tensile strength greater than about 400 g/3".

* * * * *